US005873370A

United States Patent [19]

Towle et al.

[11] Patent Number: 5,873,370

[45] Date of Patent: Feb. 23, 1999

[54] COMBINATION INCENSE STICK HOLDER, EXTINGUISHER, AND ASH TRAY

[76] Inventors: Warren J. Towle; Jeffrey T. Zimmerman, both of 104 SE. 4th St., Satellite Beach, Fla. 32937-2132

[21] Appl. No.: 927,713

[22] Filed: Sep. 11, 1997

[51] Int. Cl.[6] ..... A24F 13/08

[52] U.S. Cl. ..... 131/190; 131/238

[58] Field of Search ..... 131/238, 190, 131/231, 237, 329, 236

[56] References Cited

U.S. PATENT DOCUMENTS

| | | | |
|---|---|---|---|
| D. 242,639 | 12/1976 | Patel | D27/15 |
| D. 246,910 | 1/1978 | Patel | D23/78 |
| 2,788,911 | 11/1957 | Mellon | 131/256 |
| 2,989,964 | 6/1961 | Willett | 131/190 |
| 3,786,576 | 1/1974 | Gavlick, Sr. | 34/104 |
| 4,700,721 | 10/1987 | Grooms, Jr. | 131/238 |
| 5,115,821 | 5/1992 | Grooms, Jr. | 131/238 |

*Primary Examiner*—John G. Weiss
*Assistant Examiner*—Charles Anderson
*Attorney, Agent, or Firm*—Richard L Miller, P.E.

[57] ABSTRACT

A combination incense stick holder, extinguisher, and ash tray that is adapted to store incense sticks therein, hold a burning incense stick thereon, capture ashes from the burning incense stick, and extinguish the burning incense stick. The combination includes a box, a lid that is replaceably disposed on the box, and a holder that is disposed on the lid. The box contains a chamber for storing incense sticks. The lid selectively opens and closes the box and has a trough therein for capturing the ashes from the burning incense stick. The holder extends upwardly from the lid and is formed with a slot for holding and extinguishing the burning incense stick.

2 Claims, 1 Drawing Sheet

COMBINATION INCENSE STICK HOLDER, EXTINGUISHER, AND ASH TRAY

BACKGROUND OF THE INVENTION

1. Field of the Invention

The present invention relates to a incense stick holder. More particularly, the present invention relates to a combination incense stick holder, extinguisher, and ash tray.

2. Description of the Prior Art

Numerous innovations for incense related devices have been provided in the prior art that will be described. Even though these innovations may be suitable for the specific individual purposes to which they address, however, they differ from the present invention.

FOR EXAMPLE, U.S. Pat. No. Des. 242,639 to Patel teaches the ornamental design for a combined incense holder and ash tray.

ANOTHER EXAMPLE, U.S. Pat. No. Des. 246,910 to Patel teaches the ornamental design for a combined incense holder and ash tray.

STILL ANOTHER EXAMPLE, U.S. Pat. No. 4,700,721 to Grooms, Jr. teaches an ashtray comprising an incense holder. The incense holder is an aluminum tube inserted into a hole in the base of the ashtray. The tube includes clay inserted into the tube to aid in securing an incense stick.

FINALLY, YET ANOTHER EXAMPLE, U.S. Pat. No. 5,115,821 to Grooms, Jr. teaches an ashtray comprising one or more incense holders. The holder is crimped and can be made out of the same material as the ashtray. The incense holder can also be a separate element and attached to the ashtray. Inside the holder there is employed cork or hard rubber so as to aid in holding the incense stick.

It is apparent that numerous innovations for incense related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a combination incense stick holder, extinguisher, and ash tray that avoids the disadvantages of the prior art.

ANOTHER OBJECT of the present invention is to provide a combination incense stick holder, extinguisher, and ash tray that is simple and inexpensive to manufacture.

STILL ANOTHER OBJECT of the present invention is to provide a combination incense stick holder, extinguisher, and ash tray that is simple to use.

BRIEFLY STATED, YET ANOTHER OBJECT of the present invention is to provide a combination incense stick holder, extinguisher, and ash tray that is adapted to store incense sticks therein, hold a burning incense stick thereon, capture ashes from the burning incense stick, and extinguish the burning incense stick. The combination includes a box, a lid that is replaceably disposed on the box, and a holder that is disposed on the lid. The box contains a chamber for storing incense sticks. The lid selectively opens and closes the box and has a trough therein for capturing the ashes from the burning incense stick. The holder extends upwardly from the lid and is formed with a slot for holding and extinguishing the burning incense stick.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
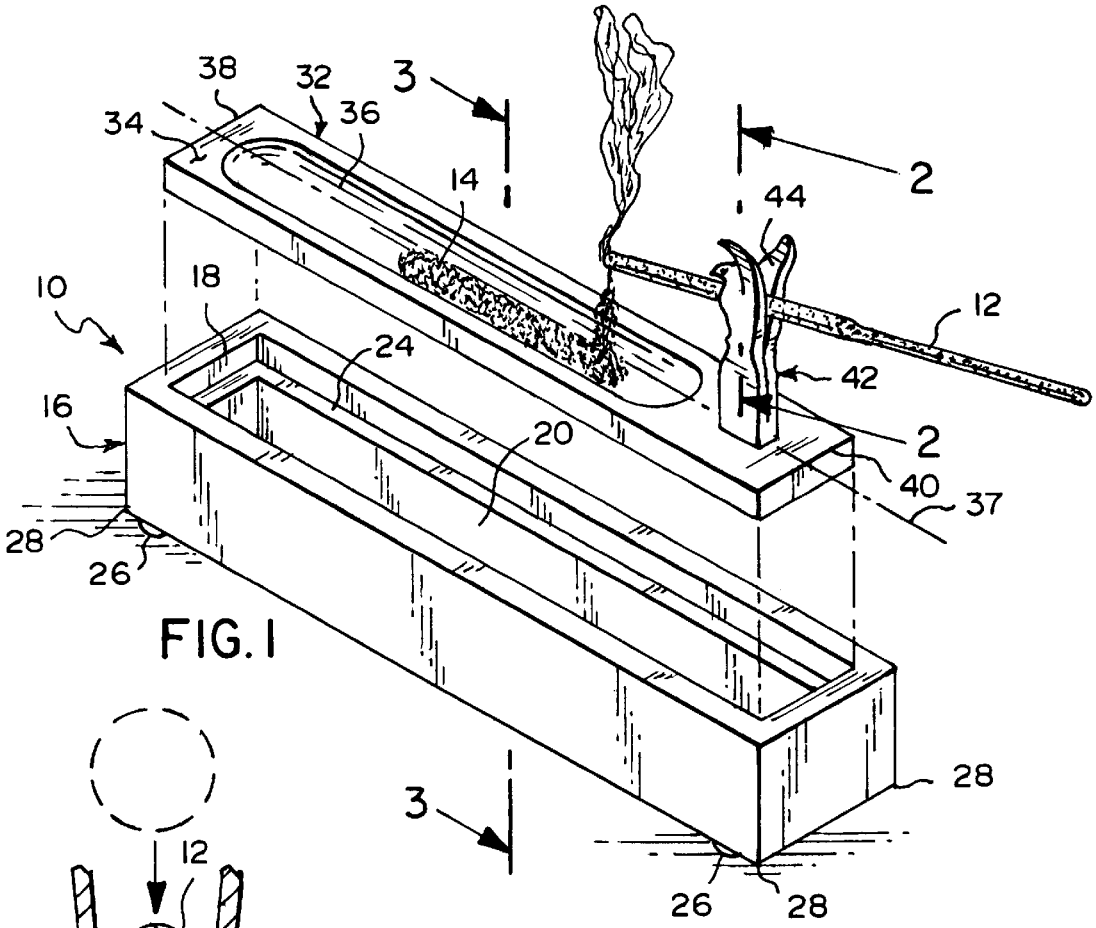
FIG. 1 is a exploded diagrammatic perspective view of the present invention in use.

10 combination incense stick holder, extinguisher, and ash tray of the present invention
12 burning incense stick
14 ashes from burning incense stick 12
16 box
18 open top of box 16
20 chamber contained in box 16
22 at least one incense stick
24 peripheral ledge of chamber 20 in box 16
26 feet on respective corner 28 of bottom 30 of box 16
28 respective corner 28 of bottom 30 of box 16
30 bottom of box 16
32 lid
34 top surface of lid 32
36 trough in top surface 34 of lid 32
37 longitudinal axis of trough 36 in top surface 34 of lid 32
38 one end of lid 32
40 other end of lid 32
42 holder
44 slot in holder 42

DETAILED DESCRIPTION OF THE PREFERRED EMBODIMENT

Referring now to the figures in which like numerals indicate like parts, and particularly to FIG. 1, the combination incense stick holder, extinguisher, and ash tray of the present invention is shown generally at 10 holding a burning incense stick 12 and capturing ashes 14 therefrom.

Figure 2:
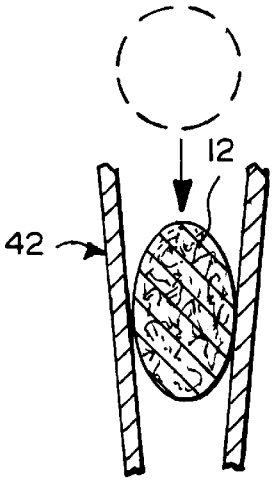
FIG. 2 is an enlarged diagrammatic cross sectional view taken on line 2—2 in FIG. 1.
Figure 3:
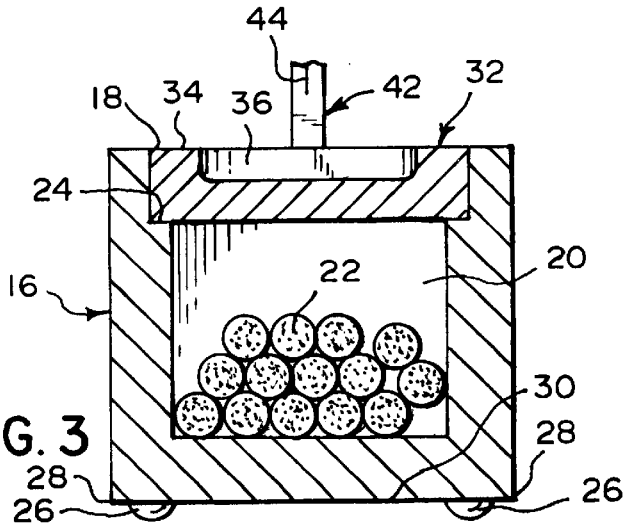
FIG. 3 is an enlarged diagrammatic cross sectional view taken on line 3—3 in FIG. 1.

The configuration of the combination incense stick holder, extinguisher, and ash tray 10 can best be seen in FIGS. 1–3, and as such will be discussed with reference thereto.

The combination incense stick holder, extinguisher, and ash tray 10 includes a box 16 that is elongated and rectangular-parallelepiped-shaped, and has an open top 18, and contains a chamber 20 that opens into the open top 18 of the box 16 and has a length adapted to store at least one incense stick 22 therein.

The chamber 20 in the box 16 has a peripheral ledge 24 completely therearound that is continuous and disposed slightly below the open top 18 of the box 16.

The box 16 further has four feet 26 that are hemispherically-shaped, with each of which being disposed at a respective corner 28 of a bottom 30 of the box 16.

The combination incense stick holder, extinguisher, and ash tray 10 further includes a lid 32 that is sized to selectively open and close the open top 18 of the box 16, and when it closes the open top 18 of the box 16, rests on the ledge 24 of the chamber 20 in the box 16.

The lid 32 has a top surface 34 with a trough 36 therein that is substantially semi-cylindrically-shaped and extends longitudinally from slightly before one end 38 of the lid 32 to short of the other end 40 of the lid 32, and has a longitudinal axis 37, and is adapted to catch the ashes 14 of the burning incense stick 12, as the burning incense stick 12 burns.

The combination incense stick holder, extinguisher, and ash tray 10 further includes a holder 42 that extends vertically-upwardly from the top surface 34 of the lid 34, at a position between the trough 36 in the top surface 34 of the lid 32 and the other end 40 of the lid 32.

The holder 42 is a flat stamping of spring metal that is bent to form a slot 44 that is vertically-oriented and adapted to replaceably and springingly hold the burning incense stick 12, at any desired point therealong, in an orientation along the longitudinal axis 37 of the trough 36 in the top surface 34 of the lid 32 so as to allow the trough 36 in the top surface 34 of the lid 32 to catch the ashes 14 of the burning incense stick 12 as the burning incense stick 12 burns and thereby causes less mess, and further adapted to be a heat sink for extinguishing the burning incense stick 12 when the burning incense stick 12 burns down and contacts it.

It will be understood that each of the elements described above, or two or more together, may also find a useful application in other types of constructions differing from the types described above.

While the invention has been illustrated and described as embodied in a combination incense stick holder, extinguisher, and ash tray, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A combination incense stick holder, extinguisher, and ash tray, comprising:

a) a box; said box being elongated and rectangular-parallelepiped-shaped, and having an open top, and containing a chamber opening into said open top of said box and having a length adapted to store at least one incense stick therein; said chamber in said box having a peripheral ledge completely therearound being continuous and disposed slightly below said open top of said box; said box further having four feet being hemispherically-shaped, with each of which being disposed at a respective corner of a bottom of said box;

b) a lid replaceably disposed on said box; said lid being sized to selectively open and close said open top of said box, and when it closes said open top of said box, resting on said ledge of said chamber in said box; said lid having a top surface with a trough therein being substantially semi-cylindrically-shaped and extending longitudinally from slightly before one end of said lid to short of the other end of said lid, and having a longitudinal axis, and being adapted to catch ashes of a burning incense stick, as the burning incense stick burns; and c) a holder disposed on said lid; said holder being a flat stamping of spring metal being bent to form a slot being vertically-oriented and adapted to replaceably and springingly hold the burning incense stick therein, at any desired point therealong, in an orientation along said longitudinal axis of said trough in said top surface of said lid so as to allow said trough in said top surface of said lid to catch the ashes of the burning incense stick as the burning incense stick burns and thereby causes less mess, and further adapted to be a heat sink for extinguishing the burning incense stick when the burning incense stick burns down and contacts it.

2. The combination as defined in claim 1, wherein said holder extends vertically-upwardly from said top surface of said lid, at a position between said trough in said top surface of said lid and said other end of said lid.

* * * * *